US007611811B2

(12) United States Patent
Yu et al.

(10) Patent No.: US 7,611,811 B2
(45) Date of Patent: Nov. 3, 2009

(54) IMAGING MEMBER

(75) Inventors: Robert C. U. Yu, Webster, NY (US); Stephen T. Avery, Rochester, NY (US); Kathleen M. Carmichael, Williamson, NY (US); Jimmy E. Kelly, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 318 days.

(21) Appl. No.: 11/315,800

(22) Filed: Dec. 22, 2005

(65) Prior Publication Data

US 2007/0148572 A1 Jun. 28, 2007

(51) Int. Cl.
*G03G 15/02* (2006.01)

(52) U.S. Cl. ..... 430/59.6; 430/66

(58) Field of Classification Search ..... 430/59.6, 430/66

See application file for complete search history.

(56) References Cited

U.S. PATENT DOCUMENTS

| | | | | |
|---|---|---|---|---|
| 3,121,006 | A | 2/1964 | Middleton et al. | |
| 4,233,384 | A | 11/1980 | Turner et al. | |
| 4,265,990 | A | 5/1981 | Stolka et al. | |
| 4,286,033 | A | 8/1981 | Neyhart et al. | |
| 4,291,110 | A | 9/1981 | Lee | |
| 4,299,897 | A | 11/1981 | Stolka et al. | |
| 4,306,008 | A | 12/1981 | Pai et al. | |
| 4,338,387 | A | 7/1982 | Hewitt | |
| 4,439,507 | A | 3/1984 | Pan et al. | |
| 4,587,189 | A | 5/1986 | Hor et al. | |
| 4,664,995 | A | 5/1987 | Horgan et al. | |
| 5,069,993 | A | 12/1991 | Robinette et al. | |
| 5,096,795 | A | 3/1992 | Yu | |
| 5,830,614 | A * | 11/1998 | Pai et al. | 430/58.7 |
| 6,027,848 | A * | 2/2000 | Pai et al. | 430/119.72 |
| 6,117,603 | A | 9/2000 | Yu et al. | |
| 6,326,111 | B1 | 12/2001 | Chambers et al. | |
| 6,337,166 | B1 | 1/2002 | Chambers et al. | |
| 2002/0018948 | A1 * | 2/2002 | Takeshima et al. | 430/58.2 |
| 2004/0126684 | A1 * | 7/2004 | Horgan et al. | 430/58.3 |
| 2004/0126685 | A1 * | 7/2004 | Horgan et al. | 430/58.3 |
| 2004/0175637 | A1 * | 9/2004 | Tong et al. | 430/58.2 |

FOREIGN PATENT DOCUMENTS

| | | | |
|---|---|---|---|
| JP | 9-68846 | * | 3/1997 |

OTHER PUBLICATIONS

Abstract of JP 9-68846 Mar. 1997.*

* cited by examiner

*Primary Examiner*—Hoa V Le
(74) *Attorney, Agent, or Firm*—Eugene O. Palazzo; Fay Sharpe LLP

(57) ABSTRACT

An imaging member having an adhesive charge transport layer is disclosed herein. The charge transport layer comprises a low surface energy polymer having siloxane segments in its backbone and a charge transport compound; it may further comprise a film-forming polymer. The charge transport layer has low surface energy, reduced coefficient of surface contact friction, and improved surface lubricity.

16 Claims, 3 Drawing Sheets

IMAGING MEMBER

BACKGROUND

This disclosure relates, in various embodiments, to electrostatographic imaging members. More specifically, the disclosure relates to an electrostatographic imaging member having a functionally improved outermost exposed imaging layer, such as a charge transport layer, which has an extended useful lifetime.

Electrostatographic imaging members are known in the art. Typical electrostatographic imaging members include (1) electrophotographic imaging members or photoreceptors for electrophotographic imaging systems and (2) electroreceptors such as ionographic imaging members for electrographic imaging systems. Generally, these imaging members comprise at least a supporting substrate and at least one imaging layer comprising a thermoplastic polymeric matrix material. In a photoreceptor, the photoconductive imaging layer may comprise only a single photoconductive layer or a plurality of layers such as a combination of a charge generating layer and one or more charge transport layer(s). In an electroreceptor, the imaging layer is a dielectric imaging layer.

Electrostatographic imaging members can have a number of distinctively different configurations. For example, they can comprise a flexible member, such as a flexible scroll or a belt containing a flexible substrate. The flexible imaging member belt may be prepared in a seamed or seamless configuration. The electrostatographic imaging member can also comprise a rigid member, such as those utilizing a rigid substrate drum. Drum imaging members have a rigid cylindrical supporting substrate bearing one or more imaging layers. Although the present disclosure is equally applicable to imaging members of any configuration, the disclosure herein after will focus primarily on flexible electrophotographic imaging members such as a flexible seamed belt.

Flexible electrophotographic imaging member seamed belts are typically fabricated from a sheet which is cut from a web. The sheets are generally rectangular in shape. The edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable means. Typical joining techniques include welding (including ultrasonic), gluing, taping, pressure heat fusing, and the like. Ultrasonic welding is generally the more desirable method of joining because it is rapid, clean (no solvents) and produces a thin and narrow seam. In addition, ultrasonic welding is more desirable because it causes generation of heat at the contiguous overlapping end marginal regions of the sheet to maximize melting of one or more layers therein to produce a strong fusion bonded seam.

A typical flexible electrophotographic imaging member belt comprises at least one photoconductive insulating layer. It is imaged by uniformly depositing an electrostatic charge on the imaging surface of the electrophotographic imaging member and then exposing the imaging member to a pattern of activating electromagnetic radiation, such as light, which selectively dissipates the charge in the illuminated areas of the imaging member while leaving behind an electrostatic latent image in the non-illuminated areas. This electrostatic latent image may then be developed to form a visible image by depositing finely divided electroscopic marking toner particles on the imaging member surface. The resulting visible toner image can then be transferred to a suitable receiving member or substrate such as paper.

A number of current flexible electrophotographic imaging members are multilayered photoreceptors that, in a negative charging system, comprise a substrate support, an electrically conductive layer, an optional charge blocking layer, an optional adhesive layer, a charge generating layer (CGL), a charge transport layer (CTL), and an optional anti-curl back coating at the opposite side of the substrate support. In such an electrophotographic imaging member design, the CTL is the outermost layer and is exposed to the environment. Since flexible electrophotographic imaging members exhibit upward curling after the application of a CTL, an anti-curl back coating is usually employed on the back side of the flexible substrate support (the side opposite from the electrically active layers) to render the imaging member flat.

In a typical machine design, a flexible imaging member belt is mounted over and around a belt support module comprising numbers of belt support rollers, such that the top outermost CTL is exposed to all electrophotographic imaging subsystems interactions. Under normal operating conditions, the top exposed CTL surface of the flexible imaging member belt is constantly subjected to physicalmechanicalelectricalchemical species interactions such as the mechanical sliding actions of cleaning blade and cleaning brush, electrical charging devices, corona effluents exposure, developer components, image formation toner particles, hard carrier particles, receiving paper, and the like during dynamic belt cyclic motion. These interactions against the surface of the CTL have been found to cause surface scratching, abrasion, and rapid CTL surface wear; in some instances, the CTL wears away by as much as 10 micrometers after approximately 20,000 dynamic belt imaging cycles. Excessive CTL wear is a serious problem because it causes significant change in the charged field potential and adversely impacts copy printout quality. Another consequence of CTL wear is the decrease of CTL thickness alters the equilibrium of the balancing forces between the CTL and the anti-curl back coating and impacts imaging member belt flatness. The reduction of the CTL by wear causes the imaging member belt to curl downward at both edges. Edge curling in the belt is an important issue because it changes the distance between the belt surface and the charging device(s), causing non-uniform surface charging density which manifests itself as a "smile" print defect on paper copies. Such a print defect is characterized by lower intensity of print-images at the locations over both belt edges. The susceptibility of the CTL surface to scratches (caused by interaction against developer carrier beads and hard particulate from paper debris) has also been identified as a major imaging member functional failure since the scratches manifest themselves as print defects.

In a rigid electrophotographic imaging member drum design utilizing a contact AC Bias Charging Roller (BCR), ozone species attack on the CTL polymer binder is more pronounced because of the close vicinity of the BCR to the CTL of the imaging member drum.

Some current CTLs have a high surface energy of about 39 dynescm. The surface of the CTL is therefore prone to collect toner residues, dirt/debris particles, and additives from receiving papers. The eventual fusion of these collected species causes the formation of comets and filming over the outer surface of the CTL, further degrading the image quality of printouts. Another problem associated with high surface energy is that it also impedes the cleaning blade and cleaning brush function.

There is a need for imaging members which exhibit good abrasion/wear/filming resistances, surface lubricity, and durability. Such imaging members have enhanced physical-mechanical service life.

REFERENCES

The following patents, the disclosure of which are incorporated in their entireties by reference, are mentioned:

U.S. Pat. No. 6,117,603 discloses an electrophotographic imaging member including a supporting substrate having an electrically conductive outer surface and at least a one layer having an exposed imaging surface, the CTL, including a continuous matrix comprising a film forming polymer and a surface energy lowering liquid polysiloxane.

U.S. Pat. No. 6,326,111 relates to a charge transport material for a photoreceptor including at least a polycarbonate polymer, at least one charge transport material, polytetrafluoroethylene (PTFE) particle aggregates having an average size of less than about 1.5 microns, hydrophobic silica and a fluorine-containing polymeric surfactant dispersed in a solvent. The presence of the hydrophobic silica enables the dispersion to have superior stability by preventing settling of the PTFE particles. A resulting CTL produced from the dispersion exhibits excellent wear resistance against contact with an AC bias charging roll, excellent electrical performance, and delivers superior print quality.

U.S. Pat. No. 6,337,166 discloses a charge transport material for a photoreceptor including at least a polycarbonate polymer binder having a number average molecular weight of not less than 35,000, at least one charge transport material, polytetrafluoroethylene (PTFE) particle aggregates having an average size of less than about 1.5 microns, and a fluorine-containing polymeric surfactant dispersed in a solvent mixture of at least tetrahydrofuran and toluene. The dispersion is able to form a uniform and stable material ideal for use in forming a CTL of a photoreceptor. The resulting CTL exhibits excellent wear resistance against contact with an AC bias charging roll, excellent electrical performance, and delivers superior print quality.

U.S. Pat. No. 4,265,990 illustrates a layered photoreceptor having a separate charge generating layer and a separate CTL. The charge generating layer is capable of photogenerating holes and injecting the photogenerated holes into the CTL. The photogenerating layer utilized in multilayered photoreceptors includes, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,233,384; 4,306,008; 4,299,897; and, 4,439,507, the disclosures of each of these patents being totally incorporated herein by reference in their entirety.

U.S. Pat. No. 5,096,795 discloses the preparation of a multilayered photoreceptor containing particulate materials for the exposed layers in which the particles are homogeneously dispersed therein. The particles reduce the coefficient of surface contact friction, increase wear resistance and durability against tensile cracking, and improve adhesion of the layers without adversely affecting the optical and electrical properties of the resulting photoreceptor.

In U.S. Pat. No. 5,069,993 issued to Robinette et al on Dec. 3, 1991, an exposed layer in an electrophotographic imaging member is provided with increased resistance to stress cracking and reduced coefficient of surface friction, without adverse effects on optical clarity and electrical performance. The layer contains a polymethylsiloxane copolymer and an inactive film forming resin binder.

U.S. Pat. No. 5,830,614 relates to a charge transport having two layers for use in a multilayer photoreceptor. The photoreceptor comprises a support layer, a charge generating layer, and two CTLs. The CTLs consist of a first transport layer comprising a charge transporting polymer (consisting of a polymer segment in direct linkage to a charge transporting segment) and a second transport layer comprising a same charge transporting polymer except that it has a lower weight percent of charge transporting segment than that of the first CTL. In the '614 patent, the hole transport compound is connected to the polymer backbone to create a single giant molecule of hole transporting polymer.

SUMMARY

There are disclosed, in various exemplary embodiments, processes and compositions for extending the functional life of an electrophotographic imaging member. These processes and compositions relate generally to a mechanically robust CTL, which has increased abrasion/scratch/wear resistance and less propensity to develop surface filming, thereby increasing imaging member service life under normal machine functioning conditions.

In one embodiment, a flexible imaging member has a charge transport layer comprising a low surface energy polymer having siloxane segments in its backbone; and a charge transport compound. In specific embodiments, the low surface energy polymer is a polycarbonate.

In another embodiment, the charge transport layer (CTL) comprises the low surface energy polymer, a compatible film forming polymer, and a charge transport compound.

In another embodiment, the CTL has a bottom layer and a top layer. The bottom layer comprises a film forming polymer different from the low surface energy polymer and a charge transport compound. The top layer comprises the low surface energy polymer. In a further embodiment, the top layer further comprises a film forming polymer (the same or different from the bottom layer) and a charge transport compound.

In another embodiment, the CTL comprises a plurality of layers. The amount of low surface energy polymer increases in each layer to reach a maximum at the outermost top layer.

In an alternative embodiment, the low surface energy top CTL comprises a plurality of layers. Each of the plurality of layers may contain the low surface energy polymer (blended with a film forming polymer) in an ascending amount to reach a maximum at the outermost top layer. In an alternative embodiment, the top layer comprises the low surface energy polymer, but does not contain film forming polymer.

Processes for making an imaging member having the CTL of the present disclosure are also provided.

These and other non-limiting features and characteristics of the exemplary embodiments of the present disclosure are described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
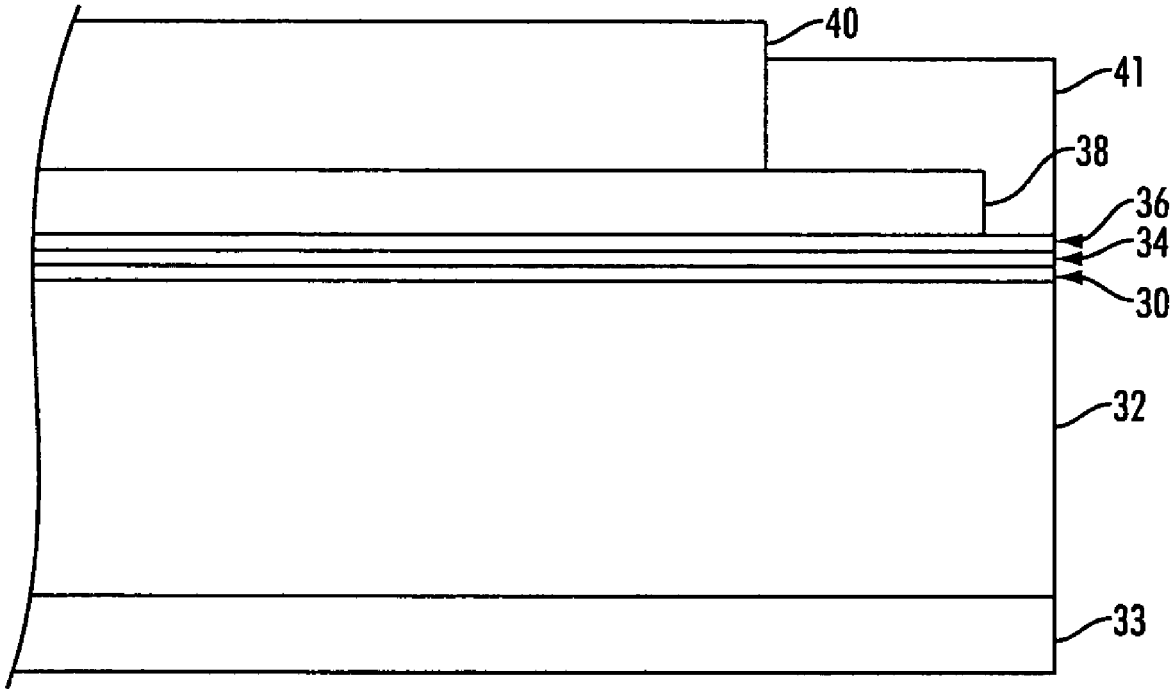
FIG. 1 is a schematic cross-sectional view of an exemplary embodiment of an imaging member having a single layer CTL.

The imaging members of this development can be used in a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are also useful in color xerographic applications, particularly high-speed color copying and printing processes. In these applications, the imaging members are in embodiments sensitive in the wavelength region of from about 500 to about 900 nanometers, and in particular from about 650 to about 850 nanometers; thus, diode lasers can be selected as the light source.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The same reference numerals are used to identify the same structure in different Figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

An exemplary embodiment of the imaging member of the present disclosure is illustrated in FIG. 1. The substrate 32 has an optional conductive layer 30. An optional hole blocking layer 34 can also be applied, as well as an optional adhesive layer 36. The charge generating layer 38 is located between the substrate 32 and the CTL 40. An optional ground strip layer 41 operatively connects the charge generating layer 38 and the CTL 40 to the conductive layer 30. An anti-curl back layer 33 is applied to the side of the substrate 32 opposite from the electrically active layers to render the imaging member flat.

Figure 2:
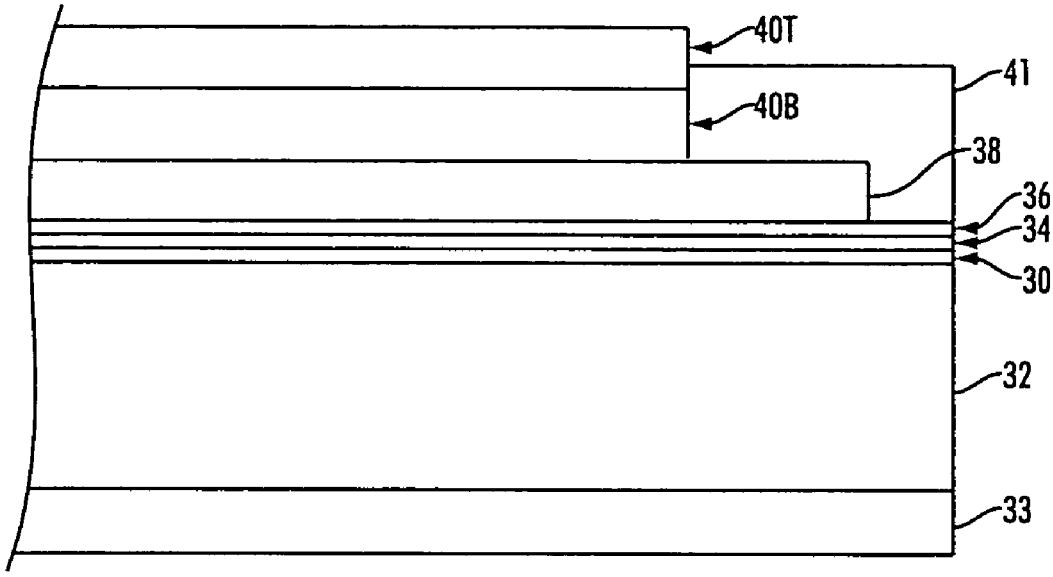
FIG. 2 is a schematic cross-sectional view of another exemplary embodiment in which the imaging member contains a dual-layer CTL.

In the exemplary embodiment of FIG. 2, the CTL comprises dual charge transport layers 40B and 40T. The dual layers 40B and 40T may have the same or different compositions.

Figure 3:
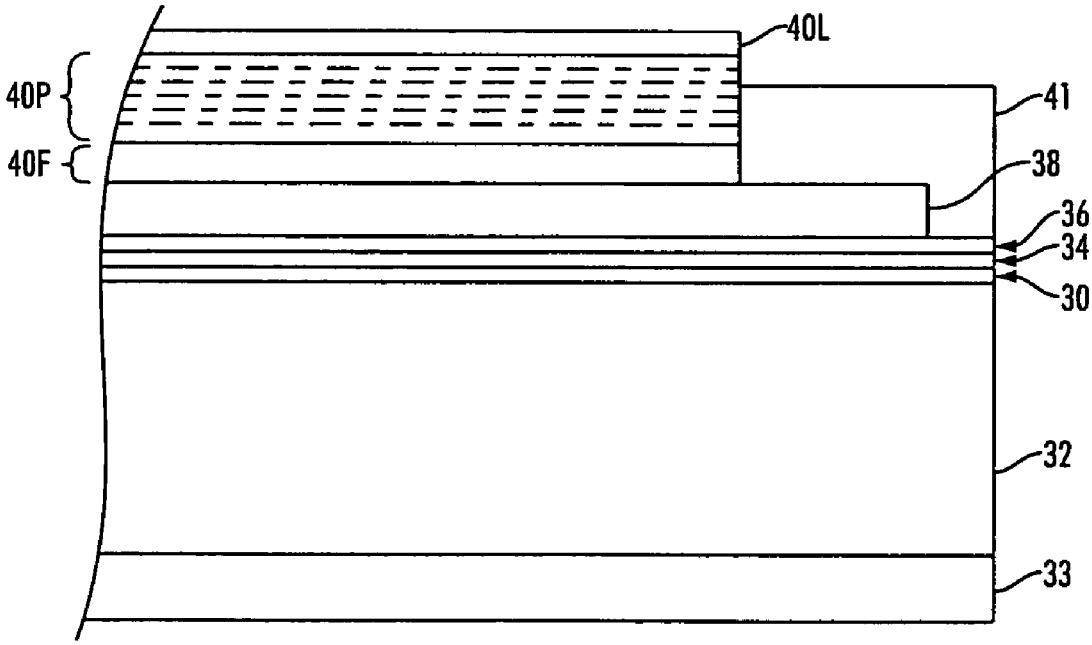
FIG. 3 is a schematic cross-sectional view of a third exemplary embodiment in which the imaging member comprises a multiple-layer CTL.

In the exemplary embodiment of FIG. 3, the CTL comprises a first (or bottom) charge transport layer 40F, one or more intermediate charge transport layers 40P, and a last or outermost charge transport layer 40L at the very top. Each layer 40P may have the same or different composition as the other layers, but the outermost charge transport layer 40L has the lowest surface energy. Since the CTL in these three figures is the outermost layer of the imaging member, it is therefore exposed to the operating environment of the machine.

The substrate 32 provides support for all layers of the imaging member. Its thickness depends on numerous factors, including mechanical strength, flexibility, and economical considerations; the substrate for a flexible belt may, for example, be from about 50 micrometers to about 150 micrometers thick, provided there are no adverse effects on the final electrophotographic imaging device. The substrate support is not soluble in any of the solvents used in each coating layer solution, is optically transparent, and is thermally stable up to a high temperature of about 150° C. A typical substrate support is a biaxially oriented polyethylene terephthalate. Another suitable substrate material is a biaxially oriented polyethylene naphtahlate, having a thermal contraction coefficient ranging from about $1\times10^{-5}$/° C. to about $3\times10^{-5}$/° C. and a Young's Modulus of from about $5\times10^{5}$ psi to about $7\times10^{5}$ psi. However, other polymers are suitable for use as substrate supports. The substrate support may also be made of a conductive material, such as aluminum, chromium, nickel, brass and the like. Again, the substrate support may flexible or rigid, seamed or seamless, and have any configuration, such as a plate, drum, scroll, belt, and the like.

The optional conductive layer 30 is present when the substrate is not itself conductive. It may vary in thickness depending on the optical transparency and flexibility desired for the electrophotographic imaging member. Accordingly, when a flexible electrophotographic imaging belt is desired, the thickness of the conductive layer may be from about 20 angstroms to about 750 angstroms, and more specifically from about 50 angstroms to about 200 angstroms for an optimum combination of electrical conductivity, flexibility and light transmission. The conductive layer may be formed on the substrate by any suitable coating technique, such as a vacuum depositing or sputtering technique. Typical metals suitable for use as the conductive layer include aluminum, zirconium, niobium, tantalum, vanadium, hafnium, titanium, nickel, stainless steel, chromium, tungsten, molybdenum, and the like.

The optional hole blocking layer 34 forms an effective barrier to hole-injection from the adjacent conductive layer into the charge generating layer. Examples of hole blocking layer materials include gamma amino propyl triethoxyl silane, zinc oxide, titanium oxide, silica, polyvinyl butyral, phenolic resins, and the like. Hole blocking, layers of nitrogen containing siloxanes or nitrogen containing titanium compounds are disclosed, for example, in U.S. Pat. Nos. 4,291,110, 4,338,387, 4,286,033 and 4,291,110, the disclosures of these patents being incorporated herein in their entirety. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and more specifically have a thickness of from about 0.2 to about 2 micrometers.

An optional adhesive layer 36 may be applied to the hole blocking layer. Any suitable adhesive layer may be utilized. One well known adhesive layer includes a linear saturated copolyester consists of alternating monomer units of ethylene glycol and four randomly sequenced diacids in a ratio of four diacid units to one ethylene glycol unit and has a weight average molecular weight of about 70,000 and a T~ of about 32° C. If desired, the adhesive layer may include a copolyester resin. The adhesive layer including the polyester resin is applied to the blocking layer. Any adhesive layer employed should be continuous and, more specifically, have a dry thickness from about 200 micrometers to about 900 micrometers and, even more specifically, from about 400 micrometers to about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited coating may be effected by any suitable conventional technique such as oven drying, infra red radiation drying, air-drying, and the like.

Any suitable charge generating layer 38 may be applied which can thereafter be coated over with a contiguous CTL. The charge generating layer generally comprises a charge generating material and a film-forming polymer binder resin. Charge generating materials such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be appropriate because of their sensitivity to white light. Vanadyl phthalocyanine, metal free phthalocyanine and tellurium alloys are also useful because these materials provide the additional benefit of being sensitive to infrared light. Other charge generating materials include quinacridones, dibromo anthanthrone pigments, benzimidazole perylene, substituted 2,4-diamino-triazines, polynuclear aromatic quinones, and the like. Benzimidazole perylene compositions are well known and described, for example, in U.S. Pat. No. 4,587,189, the entire disclosure thereof being incorporated herein by reference. Other suitable charge generating materials known in the art may also be utilized, if desired. The charge generating materials selected should be sensitive to activating radiation having a wavelength from about 600 to about 700 nm during the image wise radiation exposure step in an electrophotographic imaging process to form an electrostatic latent image.

Any suitable inactive film forming polymeric material may be employed as the binder in the charge generating layer, including those described, for example, in U.S. Pat. No. 3,121,006, the entire disclosure thereof being incorporated herein by reference. Typical organic polymer binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The charge generating material can be present in the polymer binder composition in various amounts. Generally, from about 5 to about 90 percent by volume of the charge generating material is dispersed in about 10 to about 95 percent by volume of the polymer binder, and more specifically from about 20 to about 30 percent by volume of the charge generating material is dispersed in about 70 to about 80 percent by volume of the polymer binder.

The charge generating layer generally ranges in thickness of from about 0.1 micrometer to about 5 micrometers, and more specifically has a thickness of from about 0.3 micrometer to about 3 micrometers. The charge generating layer thickness is related to binder content. Higher polymer binder content compositions generally require thicker layers for charge generation. Thickness outside these ranges can be selected in order to provide sufficient charge generation.

An optional anti-curl back coating 33 can be applied to the back side of the substrate (the side opposite the side bearing the electrically active coating layers) in order to render the imaging member flat. Although the anti-curl back coating may include any electrically insulating or slightly semi-conductive organic film forming polymer, it is usually the same polymer as used in the CTL polymer binder. An anti-curl back coating from about 7 to about 30 micrometers in thickness is found to be adequately sufficient for balancing the curl and render imaging member flatness.

An electrophotographic imaging member may also include an optional ground strip layer 41. The ground strip layer comprises, for example, conductive particles dispersed in a film forming binder and may be applied to one edge of the photoreceptor to operatively connect the CTL 40, charge generating layer 38, and conductive layer 30 for electrical continuity during electrophotographic imaging process. The ground strip layer may comprise any suitable film forming polymer binder and electrically conductive particles. Typical ground strip materials include those enumerated in U.S. Pat. No. 4,664,995, the entire disclosure of which is incorporated by reference herein. The ground strip layer may have a thickness from about 7 micrometers to about 42 micrometers, and more specifically from about 14 micrometers to about 23 micrometers.

The CTL 40 may comprise any material capable of supporting the injection of photogenerated holes or electrons from the charge generating layer and allowing their transport holes through the CTL to selectively discharge the surface charge on the imaging member surface. The CTL, in conjunction with the charge generating layer, should also be an insulator to the extent that an electrostatic charge placed on the CTL is not conducted in the absence of illumination. It should also exhibit negligible, if any, discharge when exposed to a wavelength of light useful in xerography, e.g., about 4000 angstroms to about 9000 angstroms. This ensures that when the imaging member is exposed, most of the incident radiation is used in the charge generating layer to efficiently produce photogenerated holes.

The CTL of present disclosure comprises a low surface energy film forming polymer binder and a charge transport compound to support the injection and transport of photogenerated holes or electrons. In another embodiment, the CTL comprises a charge transport compound and a polymer blend comprising a film forming low surface energy polymer and a compatible film forming polymer. Typical film forming polymer candidates suitable to blend with the low surface energy polymer are polycarbonates having a weight average molecular weight Mw of from about 20,000 to about 250,000. Polycarbonates having a Mw of from about 50,000 to about 120,000 are suitable for forming a coating solution having proper viscosity for easy CTL application. When the CTL is a polymer blend, electrically inactive polycarbonate resins suitable for use in the polymer blend may include poly(4,4'-dipropylidene-diphenylene carbonate) with a weight average molecular weight (Mw) of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company.

In one specific embodiment, the film-forming polymer is a bisphenol A polycarbonate of poly(4,4'-isopropylidene diphenyl) carbonate known as MAKROLON, available from Mobay Chemical Company, and having a molecular weight of from about 130,000 to about 200,000. The molecular structure of MAKROLON is given in Formula (I) below:

Formula (I)

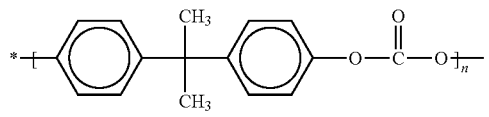

where n indicates the degree of polymerization.

In another specific embodiment, the film-forming polycarbonate is poly(4,4'-diphenyl-1,1'-cyclohexane) carbonate. The molecular structure of poly(4,4'-diphenyl-1,1'-cyclohexane) carbonate, having a Mw of about between about 20,000 and about 200,000, is given in Formula (II) below:

Formula (II)

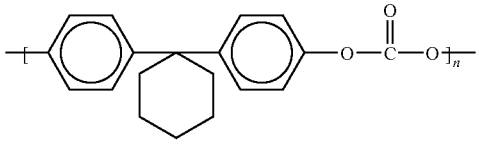

where n-indicates the degree of polymerization.

The film forming low surface energy polymer may, in particular, be derived from a polycarbonate. The low surface energy polymer should be able to effectively reduce the surface energy as well as increase surface lubricity of the formulated CTL of this disclosure. One particular polymer is a modified bisphenol A polycarbonate commercially available as LEXAN EXL 1414-T from GE Plastics Canada, Ltd (Mississauga, ONTL5N 5P2). This polycarbonate contains poly (dimethylsiloxane) (PDMS) segments in its polymer chain backbone. It has a glass transition temperature (Tg) of 150° C., a coefficient of thermal expansion of $6.6\times10^{-6}$/° C., and a Young's Modulus of $3.2\times10^{5}$ psi. The molecular structure of LEXAN EXL 1414-T is provided below in Formula (III):

Formula (III)

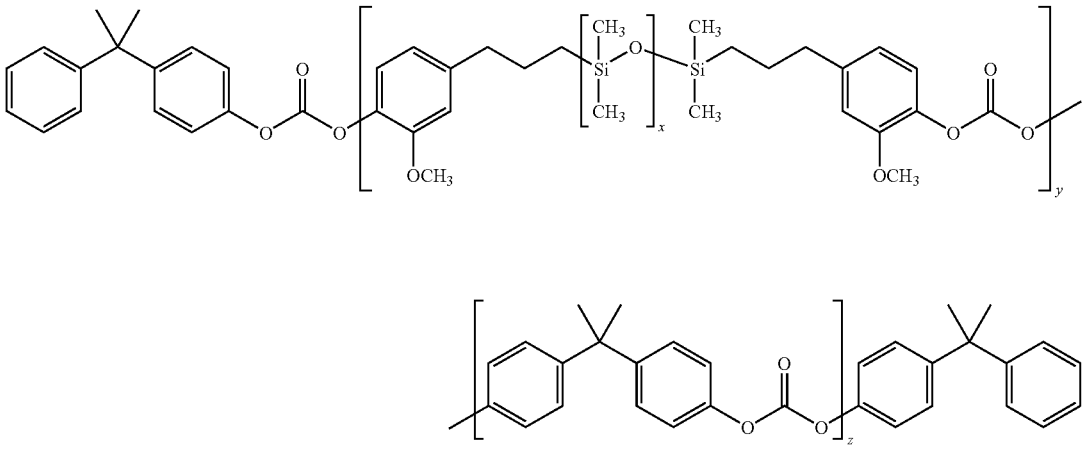

wherein x, y, and z are integers representing the number of repeating units; and x is at least 1.

Another suitable low surface energy film forming polymer modified from a polycarbonate is that having the molecular structure provided below in Formula (IV):

Formula (IV)

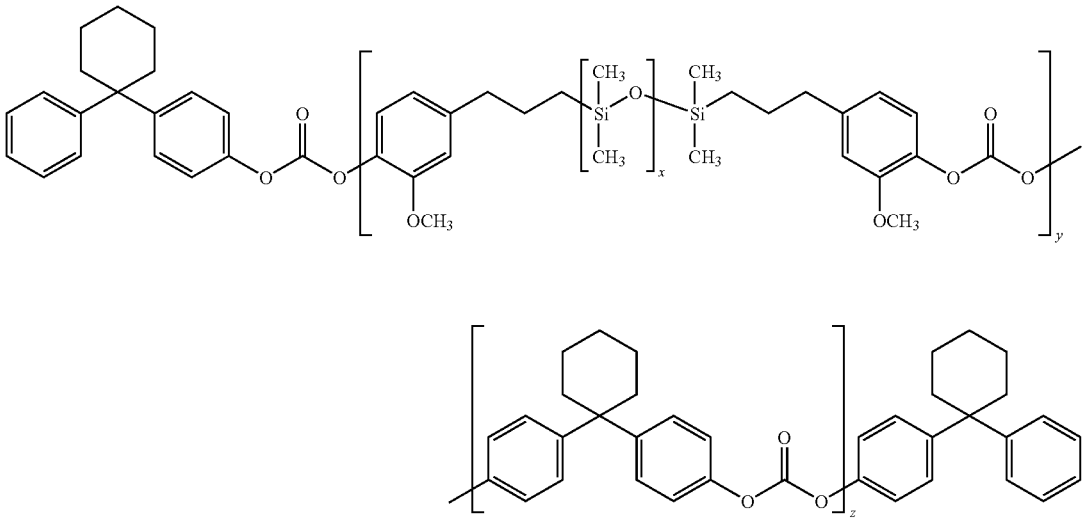

wherein x, y, and z are integers representing the number of repeating units; and x is at least 1.

The low surface energy polymer should contain from about 1 to about 20 weight percent of siloxane segments, based on the total weight of the low surface energy polymer. In specific embodiments, it contains from about 2 to about 10 weight percent of siloxane segments. In more specific embodiments, it contains from about 2 to about 8 weight percent of siloxane segments. The low surface energy polymer has a molecular weight from about 20,000 to about 200,000. In specific embodiments, it has a molecular weight from about 25,000 to about 150,000. The siloxane segments present in the polymer backbone reduce the surface energy of the formulated CTL and thereby increase its surface lubricity.

Examples of charge transport compounds used in the CTL include, but are not limited to, triphenylmethane; bis(4-diethylamine-2-methylphenyl)phenylmethane; stilbene; hydrazone; an aromatic amine comprising tritolylamine; arylamine; enamine phenanthrene diamine; N,N'-bis(4-methylphenyl)-N,N'-bis[4-(1-butyl)-phenyl]-[p-terphenyl]4,4'-diamine; N,N'-bis(3-methylphenyl)-N,N'-bis[4-(1-butyl)-phenyl]-[p-terphenyl]4,4'-diamine; N,N'-bis(4-t-butylphenyl)-N,N'-bis[4-(1-butyl)-phenyl]-[p-terphenyl]-4,4'-diamine; N,N,N',N'-tetra[4-(1-butyl)-phenyl]-[p-terphenyl]4,4'-diamine; N,N,N',N'-tetra[4-t-butyl-phenyl]-[p-terphenyl]4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)4,4'-diamine; 4,4'-bis(diethylamino)-2,2'-dimethyltriphenylmethane; N,N'-diphenyl-N,N'-bis(3-methylphenyl)-[1,1'-biphenyl]4,4'-diamine; N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine. Combinations of different charge compounds are also contemplated so long as they are present in an effective amount. In further embodiments, the charge transport compound is a diamine represented by the molecular structure below:

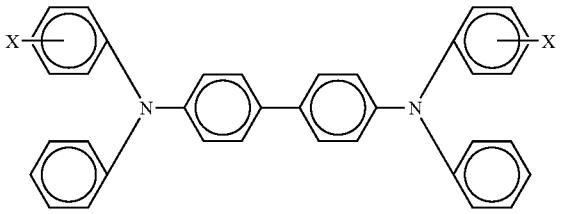

wherein X is selected from the group consisting of alkyl, hydroxy, and halogen. Such diamines are disclosed in U.S. Pat. Nos. 4,265,990, 4,233,384, 4,306,008, 4,299,897 and 4,439,507; these disclosures are herein incorporated in their entirety for reference.

The charge transport compound may comprise from about 10 to about 90 weight percent of the CTL, based on the total weight of the CTL. In an exemplary embodiment, the charge transport compound comprises from about 35 to about 75 weight percent or from about 60 to about 70 weight percent of the CTL for optimum function. Typically, the CTL has a thickness of from about 10 to about 40 micrometers. It may also have a Young's Modulus in the range of from about $3.0\times10^5$ psi to about $4.5\times10^5$ psi, a thermal contraction coefficient of from about $6\times10^{-5}$/° C. to about $8\times10^{-5}$/° C., and/or a glass transition temperature Tg of from about 75° C. to about 100° C. In some embodiments, the CTL has all of these properties.

In embodiments where the CTL comprises dual or multiple layers, as illustrated in FIGS. 2 and 3, the first layer (40B and 40F, respectively) typically comprises a film forming polymer, such as a polycarbonate, and a charge transport compound. The next layer (40T and 40P, respectively) then comprises a charge transport compound and a polymer blend comprising a low surface energy polymer and a film forming polymer. Although the layers may have the same composition, generally the weight ratio of low surface energy polymer to film forming polymer increases as the layer rises towards the surface of the imaging member. This imparts the greatest lubricity to the imaging member surface. In addition, the weight ratio of charge transport compound to polymer (both low surface energy polymer and film forming polymer) may decrease stepwise in each layer as the layer rises towards the surface of the imaging member, so that the lowest weight ratio is present in the outermost exposed layer. For example, the first layer 40F of FIG. 3 comprises a film forming polymer and charge transport compound, but no low surface energy polymer). The intermediate layers 40P comprise charge transport compound and a polymer blend comprising low surface energy polymer and film forming polymer, wherein the weight percent of low surface energy polymer in each layer would vary from about 10 to about 70 weight percent based on the total weight of the polymer blend for each layer, with the weight percent of film forming polymer being stepwise reduced in each layer (or the weight percent of the low surface energy polymer increases in each layer) that is added. In the outermost last layer 40L, the polymer blend would comprise from about 70 to about 95 weight percent low surface energy polymer. The outermost charge transport layer (40T and 40L, respectively) may also be of binary composition, comprising only the low surface energy polymer and a charge transport compound, and no film forming polymer, to achieve minimum surface energy and maximum surface lubricity.

The low surface energy film forming polymer, film forming polymer, and charge transport compound should be soluble in a common solvent suitable for use in the manufacturing process, such as methylene chloride, chlorobenzene, or some other convenient organic solvent. Generally, they are mixed together to form a coating solution. A typical solution has a 50:50 weight ratio of polymers to charge transport compound dissolved in a solvent to achieve 15 weight percent solids, based on the total weight of the coating solution.

The viscosity of the coating solution ranges from about 20 to about 900 centipoise (cp) when the solution is 15 weight percent solids. Although the viscosity of this 15 weight percent solution depends on the molecular weight of the polymers, it can also conveniently be adjusted by either changing the concentration of polymers dissolved in the solution or using another solvent.

Any suitable technique may be used to mix and apply the CTL coating solution onto the charge generating layer. Generally, the components of the CTL are mixed into an organic solvent. Typical solvents comprise methylene chloride, toluene, tetrahydrofuran, and the like. Typical application techniques include extrusion die coating, spraying, roll coating, wire wound rod coating, and the like. Drying of the coating solution may be effected by any suitable conventional technique such as oven drying, infra red radiation drying, air drying and the like. When the CTL comprises multiple layers, each layer is solution coated, then completely dried at elevated temperatures prior to the application of the next layer. This procedure is repeated for each layer to produce the CTL.

The CTL may also contain a light shock resisting or reducing agent of from about 1 to about 6 wt-%. Such light shock resisting agents include 3,3',5,5'-tetra(t-butyl)-4,4'-diphenoquinone (DPQ); 5,6,11,12-tetraphenyl naphthacene (Rubrene); 2,2'-[cyclohexylidenebis[(2-methyl4,1-phenylene) azo]]bis[4-cyclohexyl-(9CI)]; perinones; perylenes; and dibromo anthanthrone (DBA). The CTL may also reinforced to contain organic or inorganic particulate dispersions to improve wear resistance. One suitable particulate dispersion is described in U.S. Pat. No. 6,326,111, which is hereby incorporated by reference in its entirety.

In embodiments where the CTL comprises multiple layers, the specific material selected for each component of the layer may be independently selected for each layer. Typically, the same material is selected for each component of each layer and only the amount of the components is varied between layers. However, in some embodiments the outermost exposed layer (40T in FIG. 2 and 40L in FIG. 3) comprises components different from that of the other layers. For example, in one embodiment according to FIG. 3, layers 40F and 40P do not have a particulate dispersion, but layer 40L does.

In general, the ratio of the thickness of the CTL to the charge generating layer is maintained from about 2:1 to about 200:1 and in some instances as-great as about 400:1. However, the CTL is generally from about 5 micrometers to about 100 micrometers thick. Thicknesses outside this range can also be used provided that there are no adverse effects.

In embodiments where the CTL comprises multiple layers, the CTL may have a total of from about 2 to about 15 discreet layers, or from about 2 to about 7 layers, or from about 2 to about 3 layers. In other words, with reference to FIG. 3, the CTL may have a total of from 1 to about 13 intermediate layers. With reference to FIG. 3, the first or bottom charge transport layer 40F may be from about 5 to about 10 micrometers thick. Although the thickness of the first charge transport layer 40F may be the same as the collective or total thickness of the intermediate charge transport layers 40P, it is usually different. While the thickness of each of the intermediate charge transport layers 40P as well as the top layer 40L may be different, they are usually the same and range from about 0.5 to about 7 micrometers. Generally, the total thickness of a CTL having dual or multiple layers ranges from about 10 to about 110 micrometers.

In an electrographic imaging member, the dielectric layer of this disclosure overlying the conductive layer of a substrate may be used to replace all the active photoconductive layers. Any suitable, conventional, flexible, electrically insulating, thermoplastic-dielectric polymer matrix material formulated with the low surface energy polymer of the preceding description may be used for the dielectric layer of the electrographic imaging member. If required, the flexible electrographic belts may also comprise an ACBC to provide belt flatness.

The prepared flexible electrophotographic imaging member belt may then be employed in any suitable and conventional electrophotographic imaging process which utilizes uniform charging prior to image wise exposure to activating electromagnetic radiation. When the imaging surface of an electrophotographic member is uniformly charged with an electrostatic charge and image wise exposed to activating electromagnetic radiation, conventional positive or reversal development techniques may be employed to form a marking material image on the imaging surface of the electrophotographic imaging member of this disclosure. Thus, by applying a suitable electrical bias and selecting toner having the appropriate polarity of electrical charge, one may form a toner image in the charged areas or discharged areas on the imaging surface of the electrophotographic member of the present disclosure.

The development of the present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Control Example

A flexible electrophotographic imaging member web was prepared by providing a 0.02 micrometer thick titanium layer coated on a substrate of a biaxially oriented polyethylene naphthalate substrate (KADALEX, available from DuPont Teijin Films.) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran-monochloro-benzenemethylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer dispersion was prepared by adding 0.45 gram of IUPILON 200, a polycarbonate of poly(4,4'-diphenyl)-1,1'-cyclohexane carbonate (PC-z 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This charge generating layer comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a CTL and a ground strip layer by co-extrusion of the coating materials. The CTL was prepared by introducing into an amber glass bottle in a weight ratio of 1:1 (or 50 weight percent of each) of MAKROLON® 5705, a Bisphenol A polycarbonate thermoplastic having a molecular weight of about 120,000 commercially available from Farbensabricken Bayer A.G. and N,N'-diphenyl-N,N'-bis(3-methylphenyl)-1,1'-biphenyl-4,4'-diamine, a charge transport compound.

The resulting mixture was dissolved to give 15 percent by weight solid in methylene chloride. This solution was applied on the charge generating layer by extrusion to form a coating which upon drying in a forced air oven gave a CTL 29 micrometers thick comprising 50:50 weight ratio of diamine transport charge transport compound to MAKROLON® 5705 binder. The imaging member web, at this point if unrestrained, would curl upwardly into a 1½-inch tube.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (MAKROLON® 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the CTL and the ground strip.

An anti-curl coating was prepared by combining 88.2 grams of polycarbonate resin (MAKROLON® 5705), 7.12 grams VITEL PE-200 copolyester (available from Goodyear Tire and Rubber Company) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and CTL) of the electrophotographic imaging member web by extrusion coating and dried to a maximum temperature of 125° C. in a forced air oven for 3 minutes to produce a dried anti-curl back layer having a thickness of 17 micrometers and flattening the imaging member.

Disclosure Example

Three flexible electrophotographic imaging member webs were fabricated using the same materials and the same process as that described in Control Example, except with respect to the CTL coating solutions. Instead, the MAKROLON® 5705 binder was partially replaced with the low surface energy polycarbonate LEXAN EXL1414-T (PC-PDMS), available from GE plastics Canada, Ltd, Mississauga, ONT.

The prepared imaging members had resulting CTLs formed from polymer blends comprising 5, 10, and 15 weight percent, respectively, of LEXAN EXL 1414-T (PC-PDMS), based on the total weight of the polymer blend of PC-PDMS and Makrolon® 5705.

PHOTOELECTRICAl/PHYSICAL/MECHANICAL PROPERTIES ASSESSMENT

Figure 4:
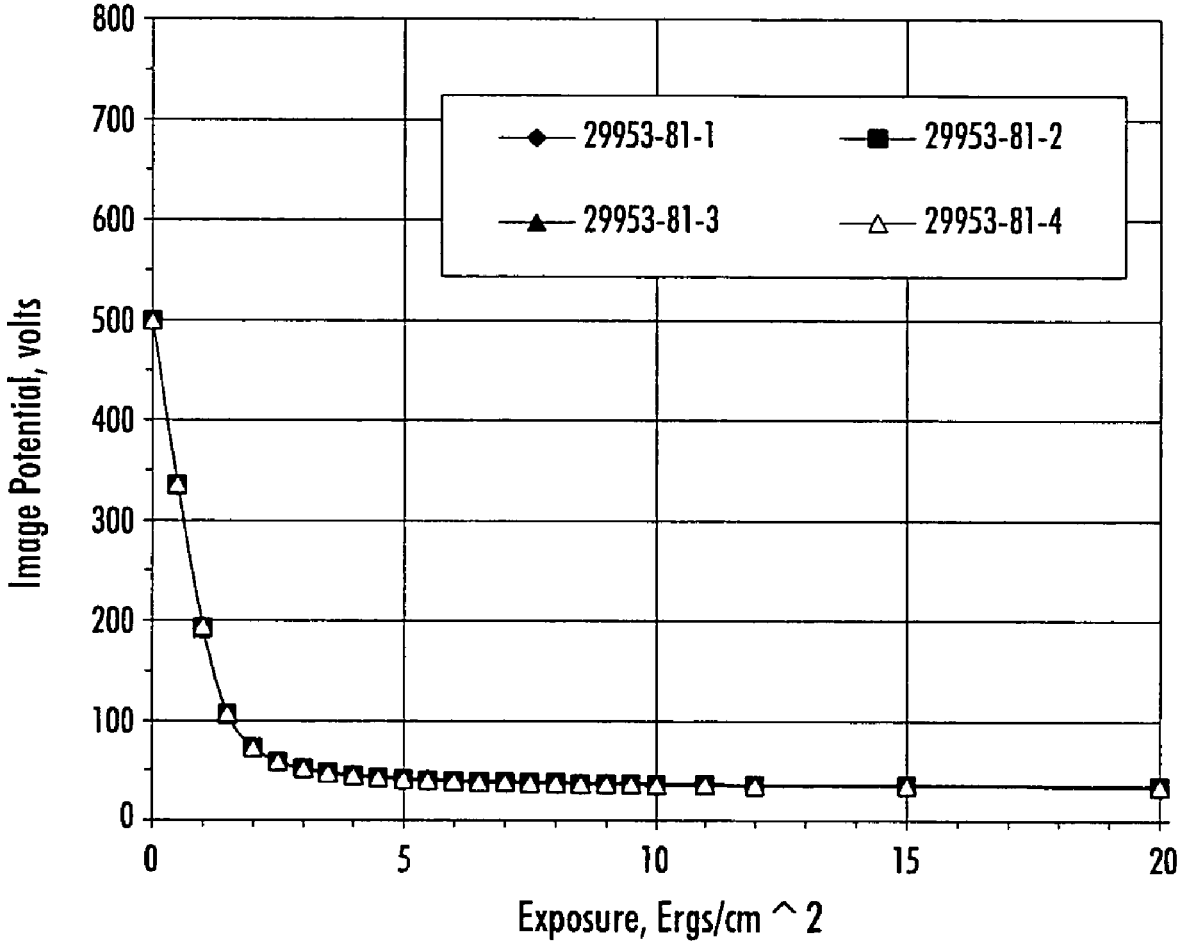
FIG. 4 is a graph illustrating the photo-induced discharge characteristics of an exemplary embodiment imaging member.

The four electrophotographic imaging members of the Control Example and the Disclosure Example were first assessed for each photo-electrical function. Photo-electrical property assessment was conducted, using a 4000 scanner, to assure that the overall photoelectrical integrity of each disclosure imaging member was not altered due to the replacement of MAKROLON® 5705 binder with LEXAN EXL 1414-T (PC-PDMS). The field results and the Photo Induced Discharge Curve (PIDC) obtained are presented in Table 1 below and shown in FIG. 4:

TABLE 1

| | % EXL | | 0K cycles | | | After 10K cycles | | |
|---|---|---|---|---|---|---|---|---|
| SAMPLE | 1414T in CTL | Vddp | Vbg 3.5 ergs | Dark Decay A | 300 erg Vr | Vbg 3.5 ergs | Dark Decay A | 300 erg Vr |
| Control | 0 | 500 | 48 | −114 | 16 | 87 | −98 | 33 |
| Disclosure | 5 | 500 | 48 | −103 | 15 | 84 | −93 | 28 |
| Disclosure | 10 | 500 | 47 | −107 | 15 | 85 | −93 | 29 |
| Disclosure | 15 | 500 | 48 | −108 | 15 | 86 | −93 | 31 |

The data show that the addition of the low surface energy polymer LEXAN EXL 1414-T to the CTL did not impact the photoelectrical properties of the imaging member.

The physical and mechanical properties, such as CTL surface energy, lubricity, and propensity of surface filming of the four imaging members were subsequently determined. The determinations were carried out by liquid wetting contact angle, sliding contact friction against a polyurethane cleaning blade, and 180° 3M adhesive tape peel-off strength measurements. The results obtained are listed below in Table 2:

TABLE 2

| SAMPLE | % EXL 1414T in CTL | Surface Energy (dynes/cm) | Static Coefficient of Friction | Tape Peel (gm/cm) |
|---|---|---|---|---|
| Control | 0 | 39 | 3.2 | 240 |
| Disclosure | 5 | 31 | 2.0 | 78 |
| Disclosure | 10 | 28 | 1.5 | 57 |
| Disclosure | 15 | 24 | 1.0 | 63 |

The results indicate that the low surface energy polymer LEXAN EXL 1414-T (PC-PDMS) film forming polymer was suitable for use in the CTL of an imaging member. The resulting CTL had low surface energy and a low coefficient of friction. The significant surface adhesiveness (opposite to adhesiveness), as seen in reduction in tape peel strength, positively indicated that the CTL had a low propensity of causing surface filming, increased abrasion wear resistance, improved the efficiency of toner image transfer to paper, and eased cleaning blade action to enhance removal of dirt debris from the imaging member belt surface during xerographic imaging processes. Additionally, the CTLs of the Disclosure Example adhered as well to the charge generating layer as the CTL of the Control Example.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An imaging member having an outermost exposed charge transport layer comprising:

a charge transport compound; and a low surface energy polymer, wherein the low surface energy polymer has the structure of Formula (III):

Formula (III)

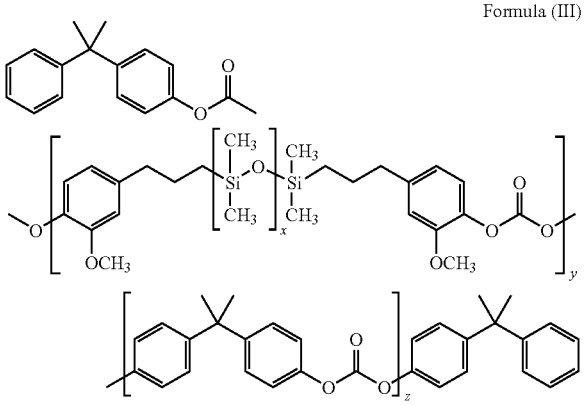

wherein x, y, and z are integers representing the number of repeating units; and x is at least 1.

2. The imaging member of claim 1, wherein the low surface energy polymer contains from about 1 to about 20 weight % of siloxane segments, based on the total weight of the low surface energy polymer; and wherein the charge transport layer further comprises a film forming polymer selected from the group consisting of poly(4,4'-isopropylidene diphenyl) carbonate and poly(4,4'-diphenyl-1,1 '-cyclohexane) carbonate.

3. The imaging member of claim 1, wherein the low surface energy polymer has a molecular weight from about 20,000 to about 200,000.

4. The Imaging member of claim 1, wherein the charge transport layer further comprises a film forming polymer selected from the group consisting of poly(4,4'-isopropylidene diphenyl) carbonate and poly(4,4'-diphenyl-1,1'-cyclohexane) carbonate.

5. The imaging member of claim 1, wherein the charge transport layer has a bottom layer and a top layer.

6. The imaging member of claim 5, wherein the low surface energy polymer is wholly contained within the top layer.

7. The imaging member of claim 5, wherein the top layer further comprises a film forming polymer selected from the group consisting of poly(4,4'-isopropylidene diphenyl) carbonate and poly(4,4'-diphenyl-1,1'-cyclohexane) carbonate.

8. The imaging member of claim 5, wherein the bottom layer has a higher weight ratio of charge transport compound than the top layer, wherein the weight ratio is based on the total weight of the layer.

9. The imaging member of claim 1, wherein the charge transport layer has a first layer, one or more intermediate layers, and an outermost last layer.

10. The imaging member of claim 9, wherein the first charge transport layer contains no low surface energy polymer.

11. The imaging member of claim 9, wherein the weight percent of low surface energy polymer with respect to charge transport compound in each intermediate layer increases going in the direction from the first layer to the outermost last layer, the weight percent in each intermediate layer based on the total weight of that intermediate layer; and the weight percent of low surface energy polymer in the last layer is greater than the weight percent of every intermediate layer.

12. The imaging member of claim 9, wherein the charge transport layer further comprises a film forming polymer selected from the group consisting of poly(4,4'-isopropylidene diphenyl) carbonate and poly(4,4'-diphenyl-1,1'-cyclohexane) carbonate.

13. The imaging member of claim 12, wherein the outermost last layer comprises the low surface energy polymer and the charge transport compound, but does not contain the film forming polymer.

14. The imaging member of claim 9, wherein there are from 1 to about 13 intermediate layers.

15. An imaging member having an outermost exposed charge transport layer, wherein the charge transport layer comprises a film forming polymer, a charge transport compound, and a low surface energy polymer having siloxane segments in its backbone;

wherein the charge transport layer has a bottom layer and a top layer;

wherein the bottom layer comprises the film forming polymer and the charge transport compound, but does not include the low surface energy polymer; and wherein the top layer comprises the low surface energy polymer and the charge transport compound, but does not include the film forming polymer;

wherein the low surface energy polymer has the structure of Formula (III):

Formula (III)

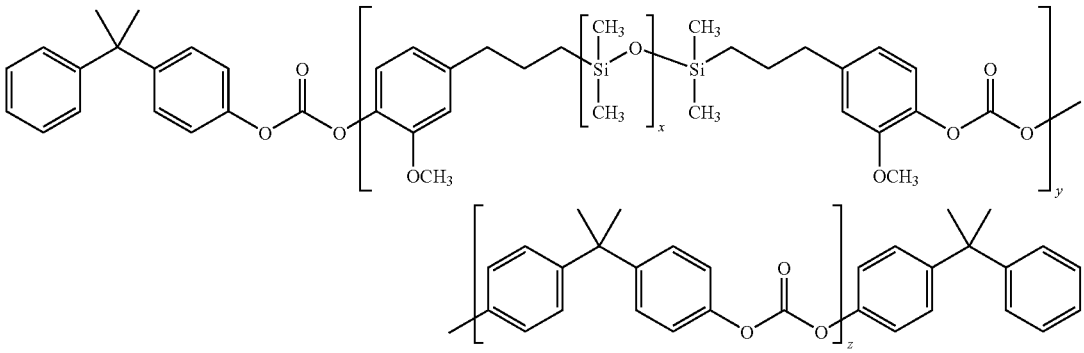

wherein x, y, and z are integers representing the number of repeating units; and x is at least 1.

16. An imaging member having an outermost exposed charge transport layer, wherein the charge transport layer comprises a film forming polymer, a charge transport compound, and a low surface energy polymer having siloxane segments in its backbone;

wherein the charge transport layer has a first layer, one or more intermediate layers, and a last outermost layer;

wherein the first charge transport layer contains no low surface energy polymer;

wherein the weight percent of low surface energy polymer in each intermediate layer increases going in the direction from the first layer to the last layer, the weight percent in each intermediate layer based on the total weight of that intermediate layer; and wherein the last layer does not contain the film forming polymer.

* * * * *